US006955193B2

(12) United States Patent
Hainsworth et al.

(10) Patent No.: US 6,955,193 B2
(45) Date of Patent: Oct. 18, 2005

(54) FIRE RESISTANT TEXTILE MATERIAL

(75) Inventors: Thomas Hainsworth, Leeds (GB); Derek Walker, West Yorkshire (GB)

(73) Assignee: A W Hainsworth & Sons Ltd., Pudsey (GB)

( * ) Notice: Subject to any disclaimer, the term of this patent is extended or adjusted under 35 U.S.C. 154(b) by 244 days.

(21) Appl. No.: 10/363,753

(22) PCT Filed: Sep. 5, 2001

(86) PCT No.: PCT/GB01/03959

§ 371 (c)(1),
(2), (4) Date: Jul. 28, 2003

(87) PCT Pub. No.: WO02/20887

PCT Pub. Date: Mar. 14, 2002

(65) Prior Publication Data

US 2005/0097877 A1 May 12, 2005

(30) Foreign Application Priority Data

Sep. 7, 2000 (GB) ..... 0021914
Jul. 13, 2001 (GB) ..... 0117128

(51) Int. Cl.[7] ..... B27N 9/00

(52) U.S. Cl. ..... 139/426 R; 139/420 A; 139/420 R; 428/921; 442/215; 442/216

(58) Field of Search ..... 2/458, 2.11, 81, 2/97, 272; 139/383 R, 420 R, 426 R, 420 A; 428/920, 921; 442/203, 209, 213, 215, 216

(56) References Cited

U.S. PATENT DOCUMENTS

| | | | | | |
|---|---|---|---|---|---|
| 3,247,569 | A | * | 4/1966 | Gliksmann et al. | 442/184 |
| 4,750,443 | A | * | 6/1988 | Blaustein et al. | 112/420 |
| 5,252,386 | A | * | 10/1993 | Hughes et al. | 442/136 |
| 5,691,040 | A | | 11/1997 | Barbeau et al. | |
| 5,874,372 | A | * | 2/1999 | Morishita et al. | 442/182 |
| 6,135,161 | A | * | 10/2000 | Nakano et al. | 139/55.1 |
| 6,182,709 | B1 | * | 2/2001 | Konishi et al. | 139/389 |
| 6,322,886 | B2 | * | 11/2001 | Branum | 428/365 |
| 6,509,091 | B2 | * | 1/2003 | Branum et al. | 428/364 |
| 6,699,802 | B1 | * | 3/2004 | Hainsworth et al. | 442/2 |

FOREIGN PATENT DOCUMENTS

| | | |
|---|---|---|
| DE | 29611356 U1 | 9/1996 |
| GB | 2319988 | 6/1998 |
| WO | WO99/16957 | 4/1999 |

* cited by examiner

*Primary Examiner*—John J. Calvert
*Assistant Examiner*—Robert H. Muromoto
(74) *Attorney, Agent, or Firm*—Beyer Weaver & Thomas, LLP

(57) ABSTRACT

A fire resistant material comprising a woven faced fabric composed or fibers from meta-aramid, polyamideimide and mixtures thereof, the woven back fabric of low thermal shrinkage fibers selected from para-aramid, polyparaphenylene terephthalamide copolymer and mixtures thereof.

20 Claims, 1 Drawing Sheet

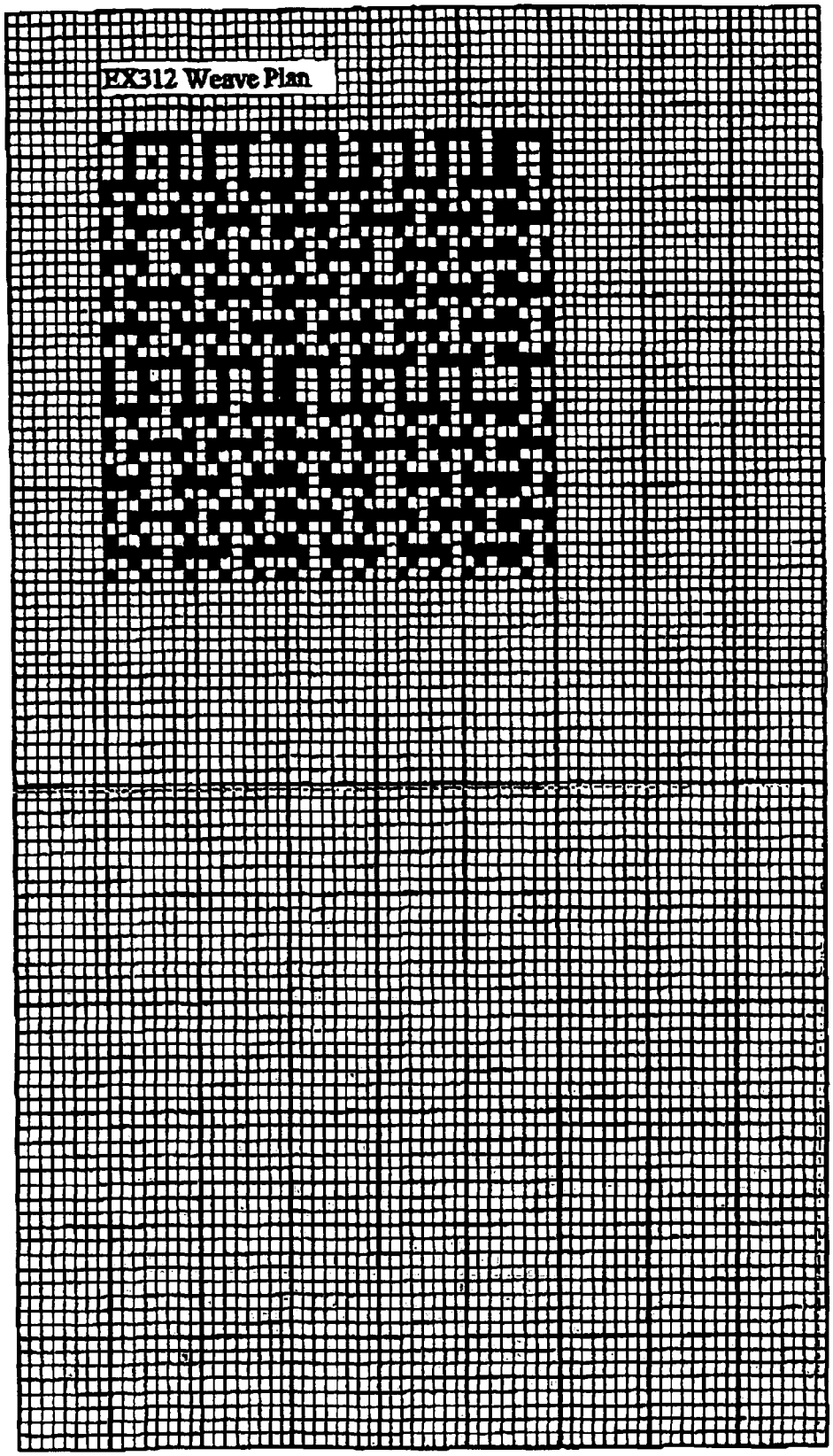
EX312 Weave Plan

FIRE RESISTANT TEXTILE MATERIAL

This invention relates to fire resistant textile materials and garments made from these materials. The invention relates particularly but not exclusively to articles of clothing for use by police, military, fire fighters and for textiles for manufacture of such clothing. European legislation requires employers to provide garments which protect their employees against hazards to which they may be exposed. Clothing for protection against heat and flame must pass minimum performance requirements for flame, radiant heat, heat resistance, tensile and tear strength, abrasion resistance and penetration by water and liquid chemicals. The assembled garments must achieve levels of resistance to heat transfer by both flame and radiant heat.

One of the most effective ways to reduce second and third degree burns is to make sure that the barrier of protective clothing between the heat source and the skin remains intact during exposure and keep an air gap between the wearer and the heat source. This is referred to as the break open resistance or non-break open protection and active air entrapment.

An object of the present invention is to optimise thermal protection offered by the fabric. We have discovered that this can be achieved through use of enhanced fabrics design and fibre utilisation.

Outer textile materials for fire fighting clothing have previously been manufactured from 100% meta-aramid or polyamideimide blends of meta-aramid and para-aramid fibres or by use of core spun yarns or staple mixtures with polyparaphenylene terephthalamide copolymer or fibres comprising para-aramid cores with meta-aramid or polyamideimide covers. The combination of these fibres in the fabric enhances the non-break open protection of the product. However meta-aramid and polyamideimide fibres shrink, consolidate and thicken when exposed to a high temperature beat source. The presence of para-aramid or polyphenylene terephthalamide copolymer in either the fibre blend or as a core can be used to prevent fibre shrinkage and consequent breaking open of the garment. However the inclusion of para-aramid fibre in the blend has been found to be insufficient in tightly woven fabrics to prevent breaking open and does not increase the air gap between the wearer and the heat source. Consequently there is a need for improved textile materials for manufacture of fire fighting garments and the like.

Fire fighting garments have been made from a plurality of textile layers, including an outer layer of woven meta-aramid fibre, for example as manufactured under the trademark Nomex. Break open protection may be afforded by blending with para-aramid fibres, e.g. as manufactured under the trademark Kevlar and as disclosed in U.S. Pat. No. 3,063,966 and U.S. Pat. No. 3,506,990. However charring of such blends may lead to cracking and embrittlement with consequent deterioration of physical properties.

PCT/GB00/01449 discloses a fire resistant textile material comprising a woven face fabric composed of fibres selected from meta-aramid, polyamideimide and mixtures thereof, the fabric including a woven mesh of low thermal shrinkage fibres.

According to the present invention a method of manufacture of a fire resistant textile material comprising a woven faced fabric composed of face fibres selected from meta-aramid, polyamideimide and mixtures thereof the fabric including a woven back of low thermal shrinkage fibres, wherein the overfeed of the lower thermal shrinkage fibres is selected so that the sum of the extension under load and take-up is approximately equal to the extension under load and take-up of the face fibres.

In a preferred embodiment the overfeed of the backing fibres is selected so that the sum of the extension under load and take-up thereof is approximately equal to the extension under load and take-up of the face fibres.

After exposure to a 10 second burn, the fabric of this invention has been found not to break open whereas currently available fabrics manufactured from a combination of these yarns fall apart under similar conditions. As there is higher shrinkage in the fibre on the surface of the fabric after thermal exposure than those on the back, the back fabric will buckle and there will be an increase the air gap between the layers.

Meta-aramid fibres may have an extension including take-up of about 35%. Para-aramid used for the back yarns may have an extension including take-up of about 7%. Accordingly an overfeed in the region of 1.28, that is a 28% overfeed may be employed in accordance with this invention.

Use of low thermal shrinkage fibres in accordance with the present invention increases the residual tensile strength of the textile material following exposure to flame or a radiant heat source. A low thermal shrinkage fibre in accordance with this invention may be defined as a fibre which exhibits not more than 6% shrinkage when exposed to a temperature of 400° C. for a period of 5 seconds.

Low thermal shrinkage fibres in accordance with the present invention may be selected from the following materials:

polyparaphenylene terephthalamide (para-aramid e.g. Kevlar), polyparaphenylene terephthalamide copolymer, polyamideimide, copolyimide, phenolic fibres obtained by cross-linkage of phenolaldehyde resin and containing more than 70% carbon, polybenzimidazole, polyetheretherketone, high tenacity viscose, silicon carbide both with a core and with an organic precursor, ceramic fibres including alumina, alumina silicate and borosilico aluminate; and glass fibres including E glass, C glass, D glass and R glass. Mixtures of the aforementioned fibres may be employed.

Preferred low shrinkage backing fibres are selected from para-aramid, polyparaphenylene terephthalamide copolymers; polyamideimide; carbon fibres and mixtures thereof.

Fibres or yarns composed of 100% polyparaphenylene isophthalamide meta-aramid (e.g. Nomex) shrink upon exposure to high temperatures, for example in excess of 295° C. This shrinkage can result in shrinkage of a whole garment exposed to a flame. The low thermal shrinkage fibres, for example para-aramid fibres or yarns do not shrink to the same extent on exposure to this temperature. The thermal shrinkage of Kevlar is about 3%, whilst the thermal shrinkage of Nomex is about 24%, if the two fibres or yarns are combined in a fabric, the shrinkage of the fabric may be controlled and/or restricted in such a way that the formation of holes, or break opening, is minimised. The direction of the distortion of the fabric in the cross-sectional direction when exposed to a high temperature may be controlled so that the fabric becomes thicker. This control is achieved by use of a woven or warp knitted face fabric. This serves to increase the thermal protection afforded by the fabric and increases the number of seconds needed to raise the temperature on the inner side to a level which would create pain or a second degree burn on human skin or on the type of sensor used in Thermal Protection Procedure (TPP) testing.

Fire resistant fabrics in accordance with this invention confer a further advantage in comparison to fabrics composed of an intimate blend of meta-aramid and para-aramid fibres. Fabric formed from an intimate blend exhibits poor retention of the new appearance. The presence of low thermal shrinkage fibres on the surface of a garment, for example Kevlar results in formation of fine fibrils due to abrasion in use. Coloured fabrics, for example: dark blue as used for fire fighters' tunics may develop light specks on the surface of the fabric. This gives an uneven appearance an a dark coloured garment. The term used to describe this effect is fabric frosting.

The low shrinkage fibres are preferably disposed behind the face fabric. This minimises exposure of the strengthening fibres to the heat source.

Fabrics in accordance with the present invention also have the advantage that degradation of the low thermal shrinkage fibres, which are more susceptible to ultra-violet light degradation than other fibres, is reduced because they are not located on the outer surface of the fabric.

In preferred embodiments of the invention the low thermal shrinkage fibres form an interwoven backing fabric on the back of the face fabric. The low thermal shrinkage fibres preferably comprise para-aramid or polyparaphenylene terephthalamide copolymer, e.g. Kevlar yarns. The thickness of the yarns may be selected in accordance with the resultant mass and weave of the finished fabric. The resultant mass ($g/m^2$) will vary dependent on the particular end use but will generally be within the range 150 to 500 $g/m^2$.

The woven fabric is preferably a combination of a face fabric into which is interwoven a backing fabric. The weave of the face fabric may vary dependent upon the mass and end use required. The interweaving of the backing scrim will be dependent on the weave of the face fabric and the thermal performance required.

In a preferred embodiment a true woven back is employed. For example the thickness may be generally doubled without an increase in weight. This can result in improved thermal resistance. The air layer between the front and back faces may protect the back layer under flame conditions. The Thermal Protective Performance (TPP) test as described below may show a 25% improvement in performance.

The textile material of this invention incorporating a woven back fabric may be a double or multiple cloth, preferably a centre stitch, self stitched or interchange double cloth. Internal stuffing yarns may be used to bulk out channels between the face and back fabrics.

In an especially preferred embodiment the textile material comprises a centre stitch double cloth. Preferably the backing fabric is overfed to create air spaces between the front and back layers. This may result in a pulled or corrugated appearance.

The extent of overfeed which may be used may be up to 35%, preferably up to 30%, more preferably in the range 25%. The extent of overfeed may be selected to balance the degrees of extension and load of the front and back axis. The extent of overfeed may be selected to give an optimum air layer in order that the TPP value may be optimised for a particular application.

Fabrics in accordance with this invention may be produced by interweaving yarns which have been spun and plied or core spun from staple fibres and/or multifilament fibres which may comprise 100% meta-aramid, 100% para-aramid, 100% polyamide imide or intimate blends of any combination of these fibres.

The interweaving of the selected yarns may be such that a closely woven fabric suitable for use as the outer face of a garment is combined with a loosely woven fabric which is suitable for use as the reverse side of the garment.

The selection of fibres and yarns which may be incorporated into fabrics in accordance with this invention will take account of the different shrinkage properties of these fibres and the particular requirements of the final fabric. A combination of high and low shrinkage fibres may be chosen. For example meta-aramid face fabric with a thermal shrinkage of approximately 24% and a para-aramid backing fabric with a thermal shrinkage of approximately 3% may be employed.

The proportion and count of face side yarns to reverse side yarns may be determined by the required weight of the final fabric, the interlacing of the face weave and the degree of effectiveness required from the properties of the reverse side yarn.

In a preferred embodiment the face yarns count may be in the range of resultant 15 to 50 Nm (Numero metric, including single or multiple folding of yarns), preferably 20 to 41 Nm. The reverse side yarns count may be in the range 25 to 150 Nm, preferably 40 to 60 Nm (Numero metric, including single or multiple folding of yarns).

Independently the proportion or ratio of face to back yarns by number may be 1:2 to 20:1, preferably 1:1 to 4:1.

The interlacing of the face weave may be determined by the desired appearance and the physical properties required of the final fabric. This interlacing may be any of a number of designs known to those skilled in the art. The preferred face weaves are plain weave, plain weave rip stop, twill weave rip stop or straight twill weaves and their derivatives. FIG. 1 EX312 shows the weaving plan for a preferred fabric. Some other cloth and weave variations are:

Self Stitched Double Cloths:

Face weaves—1×1, 1×1 Rip Stop, 2×1 Twill, 2×1 Twill Rip stop and their derivatives.

Back weaves—1×1, 2×1 Twill and their derivatives.

Centre Stitched Double Cloths (Centre stitching may be warp or weft stitching or if both this then becomes a treble cloth):

Face and Back weaves as for Self stitched cloths.

Interchanged Double Cloths:

Face and Back weaves would probably be the same to maintain a regular face effect e.g. 1×1 or 2×1 Twill although they could be different if required e.g. Face 2×1 Twill, Back 1×1, this would however give a patterned effect.

Cloths with Internal Stuffing Yarns:

Face and Back weaves would probably be as for Self Stitched Cloths with Stuffing Yarns laying between the two fabrics. The stuffing yarns could be in warp, in weft or both.

Multiple Cloths:

These would combine more than two layers of fabric i.e. Triple cloths, Quadruple cloths etc.

Each layer of fabric could utilise combinations of the weaves listed above.

Other weaves may be used if the requirements to do so arises. The degree of interlacing between the face side yarns and the reverse side yarns is important to achieve a fabric which maximises the different properties of these yarns, gives a level surface and pleasing appearance and yet can be woven with the highest possible efficiency.

In a preferred method the yarns for the warps of both the face and reverse sides of the fabric may be assembled in the specified proportions and order of working by the sectional warping process onto one or two warped beams jointly having the total number of ends required to weave the final fabric.

The weft yarns may be inserted across and interlaced with the warp yarns in the specified proportions, order of working and density selected to produce the required face and reverse side weaves.

Differential tension may be applied to the face and reverse side yarns during the weaving process and during the insertion of the weft. This is important to compensate for the varying degrees of elongation which are inherent in the different types of fibres used in those yarns and which are important to the properties of the fabric of this invention.

A preferred weaving machine which may be used to produce fabric of this invention is one that will supply the face and back warp yarns from individual warp beams at different fed rates to compensate for the varying degrees of elongation and the varying inter-lacings of the face fabric yarns and reverse side yarns.

A preferred weaving machine should also have electronic filling central braking for independent weft, tensioning to compensate for the varying degrees of elongation and the varying inter-lacings of the face fabric yarns and reverse side yarns. The differential tensioning set to weave fabric of this invention may require a breaking force of 35% for the face yarn and 75% for the reverse side yarn.

Warp knitted fabrics may also be provided in accordance with this invention.

Previously known fire-fighting garments comprise a composite of three textile layers, an outer fabric, a moisture barrier and a quilted thermal lining. The present invention may reduce the need for use of three layers, or allow the total weight of those three layers to be reduced.

The invention is further described by means of example but not in any limitative sense.

EXAMPLE 1

A textile material in accordance with the present invention (referred to in this specification as EX312) was woven using a self stitched double construction, with a blend of 93% meta-aramid, 5% para-aramid and 2% antistatic fibre (Nomex® Comfort) plain weave rip stop face and a 100% Kevlar back. It is woven in the proportions of two face to one back thread.

The overfeed of the para-aramid of 1.28, that is a 28% overfeed was employed.

Test Method

The fire resistance of textile materials in accordance with the present invention was determined using the following test method.

The Thermal Protective Performances of fabrics in accordance with this invention were measured by the Thermal Protective Performance (TPP) test. This test is a laboratory test to assess how well a fabric or combinations of fabric provides a barrier to and insulation from heat/flame.

In a "typical" flash fire the heat flux may be in the region of 80 kW/m$^2$. The test method used a heat source with a heat flux of 80 kW/m$^2$ (2 cal/cm$^2$/sec) made up of approximately 50% radiant and 50% convective heat exposed to the underside of the sample. Sensors are employed to measure a rise in temperature on the other side of the sample. This rise in temperature is correlated, via earlier research work to the tolerance of human skin and susceptibility to pain and second degree bums as used in TPP testing where "Stoll Curves" are used for the correlation. The TPP test was used to measure heat energy required on outer surface (underside) of fabric or fabric combination to cause second degree burns at the back of the fabric or fabric combination. The number of seconds required with a fixed level of energy (2 cal cm$^2$sec$^{-1}$) to reach pain and second-degree burns is also determined.

TABLE 1

| Description of Fabric Assembly | Pain (/sec) | 2$^{nd}$ degree burn (sec) | TPP (Wcm$^{-2}$) | Fabric & Fibre Factor |
|---|---|---|---|---|
| EX312 (247 g/m$^2$) Total Weight: 247 g/m$^2$ | 5.6 | 8.8 | 17.6 | 7.0 |
| Nomex III (265 g/m$^2$) Total Weight: 265 g/m$^2$ | 4.6 | 7.5 | 14.9 | 5.6 |

The results are shown in Table 1. These indicated that the energy required to give second degree burns at the back of the fabric was approximately 25% higher for the textile material in accordance with the present invention referred to as quality EX312 than a fabric of equivalent weight Nomex III fabric manufactured solely from the same fibres.

The thickness of EX312 fabric has increased from 0.7 mm before exposure to 4.3 mm after exposure, with air being trapped between the layers. This compares to the standard fabric increasing from 0.65 mm before exposure to 1.22 mm.

What is claimed is:

1. A fire resistant textile material comprising a woven faced fabric composed of face fibres selected from meta-aramid, polyamideimide and mixtures thereof, the fabric including a woven back of low thermal shrinkage fibres, wherein the overfeed of the lower thermal shrinkage fibres is selected so that the sum of the extension under load and take-up is approximately equal to the extension under load and take-up of the face fibres resulting in enhanced fabric stability after thermal exposure.

2. A textile material as claimed in claim 1, wherein the low thermal shrinkage fibres are selected from fibres having a shrinkage of less than 6% at 400° C.

3. A textile material as claimed in claim 2, wherein the low thermal shrinkage fibres are selected from polyparaphenylene terephthalamide (para-aramid e.g. Kevlar), polyparaphenylene terephthalamide copolymer, polyamideimide, copolyimide, phenolic fibres obtained by cross-linkage of phenolaldehyde resin and containing more than 70% carbon, polybenzimidazole, polyethetetherketone, high tenacity viscose, silicon carbide bath with a core and with an organic precursor, ceramic fibres including alumina, alumina silicate and borosilico aluminate; and glass fibres including E glass, C glass, D glass and R glass and mixtures thereof.

4. A textile material as claimed in claim 1 wherein the low thermal shrinkage fibres are disposed behind the face fabric.

5. A textile material as claimed in claim 1, wherein the low thermal shrinkage fibres form an interwoven backing fabric behind the face fabric.

6. A textile material as claimed in claim 1, wherein the low thermal shrinkage fibres comprise para-aramid yarns.

7. A textile material as claimed in claim 1, wherein the mass of the textile material is within the range 150 to 500 g/m$^3$.

8. A textile material as claimed in claim 1, wherein the woven fabric is a combination of a face weave on which a backing fabric is interwoven.

9. A woven textile material as claimed in claim 1, wherein the face yarns count is in the range of resultant 15 to 50 Nm.

10. A woven textile material as claimed in claim 9, wherein the face yarns count is in the range of resultant 20 to 41 Nm.

11. A woven textile material as claimed in claim 9, wherein the reverse side yarns count is in the range 150 Nm.

12. A woven textile material as claimed in claim 11, wherein the reverse side yarns count is in the range 40 to 60 Nm.

13. A woven textile material as claimed in claim 9, wherein the ratio of face to back yarns by number is in the range 1:1 to 20:1.

14. A woven textile material as claimed in claim 13, wherein the ratio of face to back yarns by number is in the range 1:1 to 4:1.

15. A woven textile material as claimed in claim 1, wherein the face weave is selected from: plain weave, plain weave rip stops, straight twills, twill weave rip stops and their derivatives.

16. A woven textile material where the thermal shrinkage of the face fibre is between 10 and 35%.

17. A woven textile material where the thermal shrinkage of the back fabric is between 2 and 10%.

18. A woven textile that increases in thickness between 2 and 10 times by differential shrinkage of fibre woven in the fabric, after exposure to a heat flux in excess of 40 $KW/m^2$.

19. A woven textile that deforms to trap air in the fabric structure.

20. A woven material that keeps 30% of its strength after exposure to 80 $KW/m^2$ of heat flux.

* * * * *